United States Patent [19]

Sato

[11] Patent Number: 4,875,313

[45] Date of Patent: Oct. 24, 1989

[54] DEVICE FOR SUPPRESSING VIBRATION OF STRUCTURE

[75] Inventor: Takanori Sato, Tokyo, Japan

[73] Assignee: Shimizu Construction Co., Ltd., Tokyo, Japan

[21] Appl. No.: 196,325

[22] Filed: May 20, 1988

[30] Foreign Application Priority Data

Nov. 17, 1987 [JP] Japan ..... 62-290231

[51] Int. Cl.[4] ..... E02D 27/34

[52] U.S. Cl. ..... 52/167 DF; 52/1

[58] Field of Search ..... 52/168, 167; 5/451; 405/32, 24

[56] References Cited

U.S. PATENT DOCUMENTS

| | | | |
|---|---|---|---|
| 4,226,554 | 10/1980 | Vandiver | 52/168 |
| 4,292,702 | 10/1981 | Phillips | 5/451 |
| 4,301,560 | 11/1981 | Fraige | 5/451 |
| 4,332,043 | 1/1982 | Larson | 5/451 |
| 4,430,764 | 2/1984 | Finkelstein | 5/451 |
| 4,481,248 | 11/1984 | Fraige | 5/451 |
| 4,627,121 | 12/1986 | Winther | 5/451 |
| 4,710,057 | 12/1987 | Laier | 405/32 |
| 4,783,937 | 11/1988 | Sato . | |

FOREIGN PATENT DOCUMENTS

| | | | |
|---|---|---|---|
| 2234779 | 2/1975 | France | 405/32 |
| 579388 | 12/1977 | U.S.S.R. | 52/168 |
| 999421 | 7/1965 | United Kingdom . | |
| 1322807 | 7/1973 | United Kingdom . | |

*Primary Examiner*—Henry E. Raduazo

*Attorney, Agent, or Firm*—Hoffman & Baron

[57] ABSTRACT

There is disclosed a device for suppressing vibration of a structure such as building, a bridge and the like. The vibration-suppressing device includes a tank disposed on the structure, a liquid contained in the tank, and damping mechanism disposed within the tank. The amount of the liquid is such that the natural period of the liquid is equal to that of the structure. The damping mechanism is of a net construction. When the structure is vibrated due to earthquake, wind or the like, the liquid in the tank vibrates for a quarter of a period out of phase compared to the structure, thereby suppressing the vibration of the structure. After suppressing the structure's vibration, the vibration of the liquid is effectively dampened as the liquid passes through the mesh of the dampening mechanism.

17 Claims, 3 Drawing Sheets

DEVICE FOR SUPPRESSING VIBRATION OF STRUCTURE

BACKGROUND OF THE INVENTION

This invention relates to an improvement in a device for suppressing vibration of a structure such as a building, bridge and the like, the vibration being caused by a vibration source such as wind, earthquake, traffic and the like.

In recent development made in the field of high strength materials and in the rapid progress made in both construction engineering and computerized structure analysis, modern buildings and civil structures have been enlarged in scale, varied in types, and have become comparatively lightweight and flexible. As the buildings and the structures become more lightweight and more flexible, their natural frequency and vibration damping factors tend to be more lessened. Hence, there is the possibility that various kinds of vibration may unexpectedly occur in the structures due to a vibration source such as earthquake, wind, traffic and the like. In particular, as building structures are enlarged in scale, the amplitude of vibration of the structures caused by a vibration sources is enlarged. Such a large amplitude vibration of the structures is likely to give uneasiness to occupants of the building structures and also to induce excess stresses beyond an allowable level in the structures.

To eliminate the inconvenience described above, the inventor of the present invention has previously proposed, in Japanese Patent Application No. 60-241045, a device for suppressing vibration of a structure. This device has a tank disposed at a predetermined position such as the roof and the like of the structure. The tank contains such an amount of liquid that the natural period of the liquid is equal to that of the structure. When the structure is vibrated due to a vibration source, the liquid in the tank is also vibrated with the same vibration period as the structure for a quarter of a period out of phase compared to the structure, thereby suppressing the vibration of the structure.

However, since the above mentioned prior device suppresses the vibration of the structure by the liquid vibrating together with the structure, there is a possibility of the device acting adversely as a vibrator for the structure after the vibration amplitude of the structure becomes smaller than that of the liquid in the tank. Therefore, it has been required that the vibration-suppressing device should have suitable means for positively dampening the vibration of the liquid depending on the arrangement of the structure and on the scale of the device.

SUMMARY OF THE INVENTION

Accordingly, it is an object of the present invention to provide an improved vibration-suppressing device for a structure, in which the vibration of the liquid in the tank is effectively dampened.

With this and other objects in view, the present invention provides a vibration-suppressing device which includes a tank disposed on the structure, a liquid contained in the tank, and means for damping the vibration of the liquid. The amount of the liquid in the tank is such that the natural period of the liquid is equal to that of the structure. The damping means is of a net construction and is disposed within the tank. When the structure is vibrated due to a vibration source, the liquid in the tank vibrates for a quarter of a period out of phase compared to the structure, thereby suppressing the vibration of the structure. After suppressing the structure's vibration, the vibration of the liquid is effectively dampened as the liquid passes through the mesh of the dampening means.

It is preferred that the dampening means includes one or more coaxial tubular mesh screen members mounted to one of both the tank and the structure in such a manner that the axes of the screen members are disposed substantially vertically. Each of the screen members may have a substantially circular cross section or a substantially polygonal cross section. The screen members may be mounted to the bottom wall of the tank, otherwise, they may be mounted on the inner face of a lid member which closes the open top of the tank.

Alternatively, the dampening means may include a plurality of plate-like mesh screen members mounted to the tank. In this case, the mesh screen members are substantially horizontally disposed one on top of another. A spacer member may be interposed between each of the screen members and the adjoining screen member so that the screen members are vertically spaced apart from one another. Furthermore, each of the screen members may be of a corrugated plate-like construction. In this case, the ridge lines of each of the screen members may extend in a direction intersecting the ridge lines of the adjoining screen member.

DETAILED DESCRIPTION OF THE PREFERRED EMBODIMENTS

Figure 1:
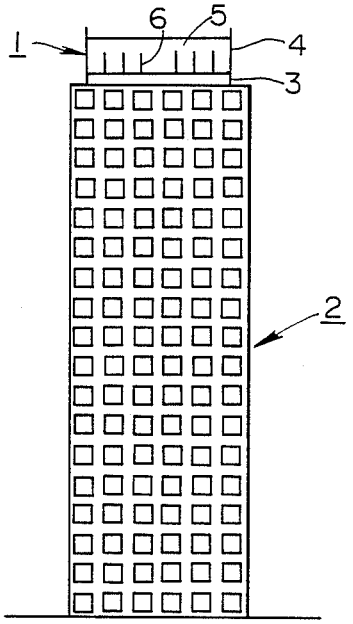
FIG. 1 is a diagrammatic front view of a building on which a vibration-suppressing device according to the present invention is installed.

Referring now to the drawings, wherein like reference characters designate corresponding parts throughout several views, and descriptions of the corresponding parts are omitted once given.

FIG. 1 illustrates a structure in the form of a high-rise building 2 which has a vibration-suppressing device 1 according to the present invention. The device 1 is installed on the roof of the building 2, where the device 1 is able to most effectively suppress the vibration of the building caused by wind.

Figure 2:
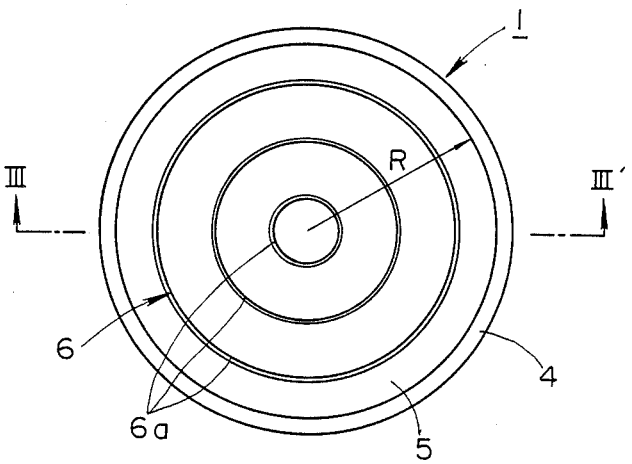
FIG. 2 is an enlarged plan view of the vibration-suppressing device in FIG. 1.
Figure 3:
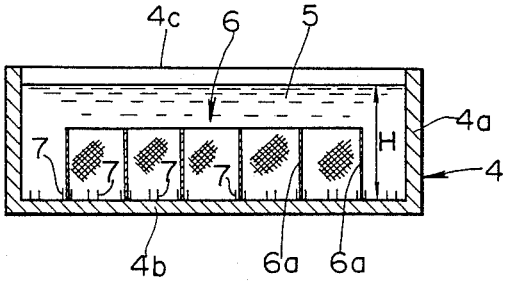
FIG. 3 is a view taken along the line III—III of FIG. 2.

The vibration-suppressing device 1 includes a laminated-support base 3 fixed to the roof of the building 2, a tank 4 mounted on the support base 3, a liquid 5 contained within the tank 4, and damping means 6 disposed in the tank 4 to dampen the vibration of the liquid. The support base 3 consists of steel sheets and resilient sheets alternately laid one on top of another. Each resilient sheet is made of a resilient material such as a rubber, synthetic resin and the like. As shown in FIGS. 2 and 3, the tank 4 has a hollow cylindrical side wall 4*a*, a bottom wall 4*b* closing the lower end of the side wall 4*a*, and an open top 4*c*. The liquid 5 is, for example, water used as drinking water, a fire extinguisher, and a cooling and/or heating medium for an air conditioner. The level of the liquid 5, i.e., the distance H (see FIG. 3) between the liquid surface and the bottom wall 4*b* is adjusted to a predetermined level depending on the specific gravity of the liquid 5 so that the natural period of the liquid 5 is equal to that of the building 2. The mass of the liquid 5 is within the range of 1/50 to 1/100 of that of the building 2.

Referring again to FIGS. 2 and 3, the damping means 6 consists of a plurality of hollow cylindrical mesh screen members 6*a* disposed concentric with the side wall 4*a* of the tank 4 and fixed to the bottom wall 4*b* of the tank 4. The diameters of the screen members 6*a* are different from one another so that the screen members 6a are arranged coaxial to one another. Each of the screen members 6*a* is constituted of a frame of a tubular skeleton construction and a net wound around the frame. The net is prepared by weaving fibrous strings, metal wires or the like. The suitable number and proper sizes of the screen members 6*a* are determined depending o the amount of the liquid 5, the physical properties of the liquid 5 and the like. Mounting means in the form of a plurality of mount brackets 7 are fixed to the bottom wall 4*b* of the tank 4. These mount brackets 7 detachably interconnect the bottom wall 4*b* of the tank 4 and the lower ends of the screen members 6*a*. The number of the brackets 7 may be more than the essential number of the screen members 6a so that extra screen members are added as occasion calls. The tank 4 is made of a material such as a plastic which does not corrode over a long period of time. Similarly, the liquid 5 is, preferably, a viscous liquid such as an oil which is not easily evaporated over a long period of time. However, suitable material of the tank 4 and a proper liquid as the liquid 5 may be selected depending on the construction condition of the device 1 and therefore should not be limited to those described above.

The operation of the vibration-suppressing device 1 disclosed above will now be described.

Figure 4:
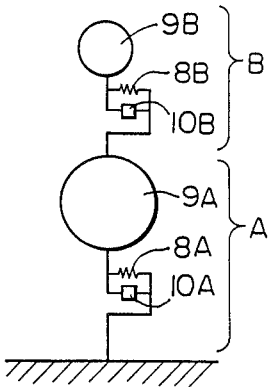
FIG. 4 is a view of a conceptual model of the vibration system composed of the building structure and the vibration-suppressing device in FIG. 1.

In principle, a vibration system including the vibration-suppressing device 1 and the building 2 shows vibration properties similar to that of a vibration model shown in FIG. 4. This vibration model is composed of a first vibration system A which represents the building 2, and a second vibration system B which represents the liquid 5, the first and second vibration systems A and B being connected in series. The first vibration system A includes a body 9A of mass $M_0$, a first spring 8A having a spring constant $K_0$ and supporting the first body 9A, and a first dashpot 10A having a damping factor $h_0$ and connected parallel to the first spring 8A. The second vibration system B includes a second body 9B of mass $M_1$, a second spring 8B having a spring constant $K_1$ and interconnecting the first and second bodies 9A and 9B, and a second dashpot 10B having a damping factor $h_1$ and connected parallel to the second spring 8B.

In the above-described vibration model, when the vibration system A is vibrated due to a vibration source such as earthquake and wind, the vibration energy is transmitted from the system A to the system B, and thus, the vibration system B begins to vibrate for a quarter of a period out of phase in comparison with the vibration system A. In this case, since the vibration period of the liquid 5 is equal to the natural period of the building 2, the vibration of the vibration system A is effectively suppressed by the vibration of the vibration system B. How to make the vibration period of the liquid 5 equal to the natural period of the building 2 is hereinafter described.

Since the mass $M_1$ of the second body 9B is not more than about 2% of the mass $M_0$ of the first body 9A, the natural period $T_0$ of the building 2 is defined approximately by following equation (1):

$$T_0 = 2\pi\sqrt{M_0/K_0} \tag{1}$$

On the other hand, the natural period $T_1$ of the liquid 5 is defined by following equations (2):

$$T_1 2\pi/\omega \tag{2}$$

where $\omega$ is the natural frequency of the liquid 5, i.e., the natural frequency of sloshing of the liquid 5. According to the Housner Theory, the natural frequency * is defined by following equation (3):

$$\omega^2 = (H/R)\sqrt{27/8}\cdot\tanh(\sqrt{27/8}\cdot H/R) \tag{3}$$

where H is the level of the liquid 5, and R is the radius of the tank 4 (see "Dynamic Pressures on Accelerated Fluid Containers" by Housner, G. W., Bulletin of the Seismological Society of America, vol. 47(1957) , pp. 15–35). That is, by appropriately selecting the variables H and R, i.e., the amount of the liquid 5 and the size of the tank 4, it is possible to make the natural period $T_1$ of the liquid 5 equal to the natural period $T_0$ of the building 2 so that the vibration of the building 2 is suppressed by the device 1.

In addition, the ratio of the mass $M_1$ of the liquid 5 over the mass $M_0$ of the building 2 should not be less than 1/200 and not more than 1/50. Below 1/200, the device 1 does not show an efficient vibration-suppressing effect. Above 1/50, the weight of the liquid 5 would influence the structural design of the building 2, in other words, the weight of the liquid 5 would make it necessary to change the design of the building 2.

As has been described above, the device 1 is able to effectively suppress the vibration of the building 2 caused by a vibration source. In addition to this ability, the device 1 has an ability to dampen the vibration of the liquid 5 since the device has the screen members 6*a*. When the liquid 5 vibrates in the tank 4 due to the vibration of the building 2, it passes through the mesh of the screen members 6*a*. As the liquid 5 passes through the mesh, kinetic energy of the liquid 5 reduces in the same manner as an impact energy transmitted to the dampening liquid of a hydraulic shock absorber is reduced as it passes through the orifice in the absorber. Consequently, the vibration of the liquid 5 is effectively dampened. This dampening effect influences not only the device 1 itself but also the building 2. More specifically, as the vibration of the liquid 5 is dampened, the vibration of the building 2 as well as the vibration of the device 1 is dampened. As a result, the vibration-suppressing device 1 does not act as a vibrator for the building 2 after suppressing the vibration of the building.

Figure 5:
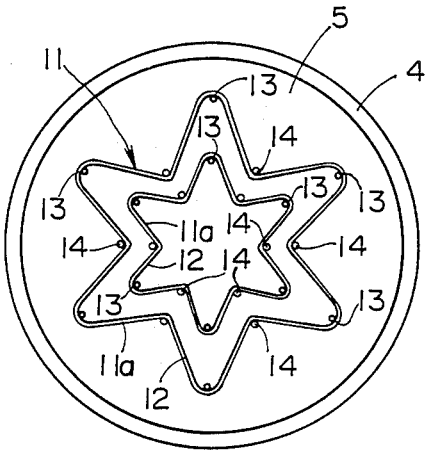
FIG. 5 is a plan view, similar to FIG. 2, of a modified form of the vibration-suppressing device in FIG. 1.

FIG. 5 illustrates a modified form of the vibration-suppressing device in FIGS. 1 to 3, in which a dampening means 11 consists of a plurality of coaxial tubular screen member 11*a* having star-like cross sections. Each of the screen members 11*a* includes a net 12, a plurality of first vertical posts 13, and plurality of second vertical posts 14. The first and second posts 13 and 14 are erected on the bottom wall 4*b* of the tank 4 and are circumferentially and alternately arranged on the bottom wall 4*b* at angular intervals about the axis of the tank 4. The distance between each first post 13 and the axis of the tank is longer than the distance between each second post 14 and the axis of the tank 4. The net 12 is routed alternately around the first and second posts 13 and 14 to form the tubular screen member 11*a* having the star-like cross section. In this arrangement, the screen members 11*a* extend not only in the circumferential direction of the tank 4 but also in the radial direction of the tank 4. Therefore, this modified form device is capable of dampening vibration of the liquid 5 accompanied by rotational flow of the liquid 5 about the axis of the tank 4 as well as dampening vibration of the liquid 5 accompanied by the radial flow of the liquid 5. More specifically, when an aerodynamic force caused by wind is applied to the building which has its center of gravity positioned separately from its center of rigidity, the building is forced to swing about its vertical axis. This modified form device is capable of suppressing such a swing of the building and also of dampening the rotational flow of the liquid 5 due to the swing of the building.

Figure 6:
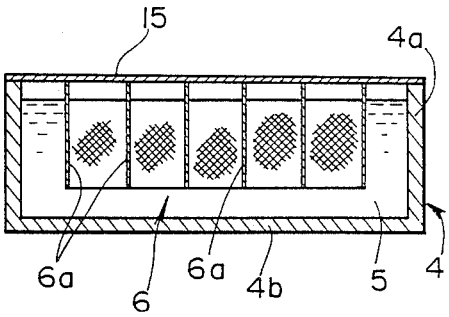
FIG. 6 is a vertical-sectional view, similar to FIG. 3, of another modified form of the vibration-suppressing device in FIG. 1.

Another modified form of the vibration-suppressing device in FIGS. 1 to 3 is illustrated in FIG. 6. In this modified form, the tank 4 has a lid member 15 closing the open top 4*c* of the tank 4. The upper ends of the coaxial cylindrical screen members 6a are fixed to the inner face, that is, the lower face of the lid member 15 in such a manner that the screen members 6*a* are coaxial with the side wall 4*a* of the tank 4. This modified form device is able to achieve effects similar to that obtained by the device in the first embodiment. In other words, the proper positions of the screen members 6 with respect to the tank 4 may be determined in accordance with the shape and installation condition of the tank 4.

Figure 7:
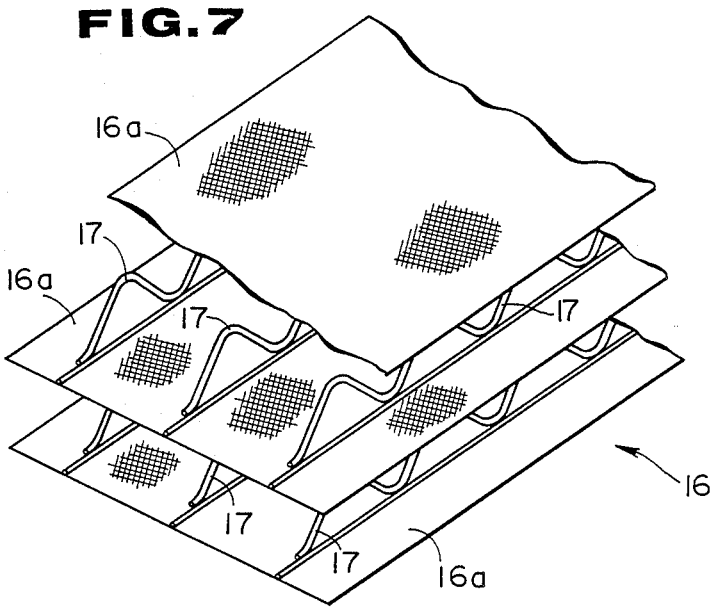
FIG. 7 is a perspective view of a modified form of a dampening means shown in FIG. 1.

A modified form of the dampening means 6 is shown in FIG. 7. This dampening means 16 includes a plurality of plate-like screen members 16*a* fixed to the tank 4 and horizontally disposed one on top of another. A plurality of parallel lattice girder-like spacer members 17 are interposed between each of the screen members 16*a* and the adjoining screen member 16*a* so that the screen members are vertically spaced apart from one another.

Figure 8:
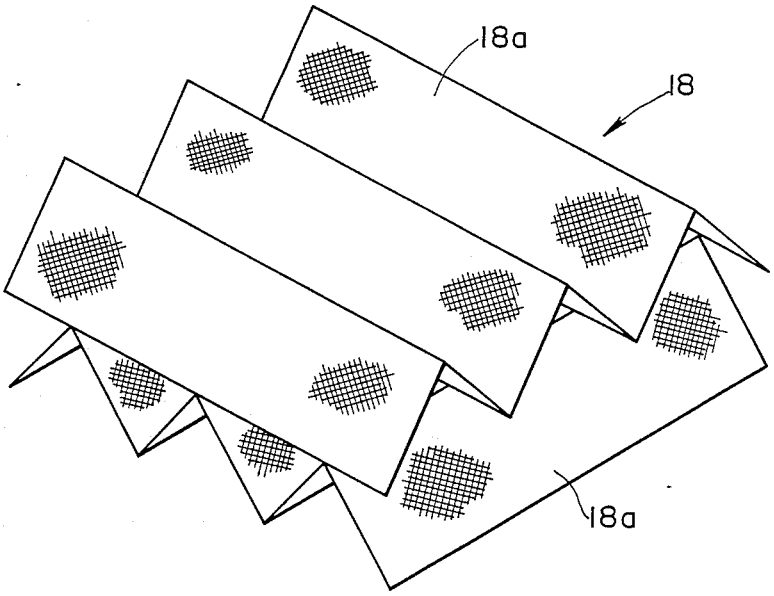
FIG. 8 is a perspective view of another modified form of the dampening means in FIG. 1.

FIG. 8 shows another modified form of the dampening means 6, in which the modified form dampening means 18 consist of a plurality of corrugated plate-like screen members 18*a* horizontally laid one on top of another. These screen members 18*a* are arranged in the tank 4 so that the ridge lines of each screen member 18*a* extend in a direction intersecting the ridge lines of the upper or lower adjoining screen member 18*a*. This modified form device is capable of dampening vibration of the liquid 5 accompanied by the flow of the liquid 5 in the various directions including the circumferential and radial directions.

Although in the foregoing embodiment and modified forms, the dampening means 6, 11, 16 and 18 are mounted to the tank 4, they may be mounted or fixed to the building 2 through a frame constructed on the building 2. More specifically, the dampening means may hang down from the frame and be put into the liquid 5 in the tank 4. The tank 4 may be installed within the building 2 instead of being mounted on the roof of the building 2. The number of the screen members, mesh size of the screen members and the angle of the screen members with respect to the liquid surface may be determined according to the shape of the tank 4, installation condition of the tank 4 or the like. The fibrous strings or the metal wires which is used in the screen members may have an outer sheath member made of material such as nonwoven fabric and the like so that the screen members are effectively resistant to the liquid 5 passing through the mesh of the screen members. The net of each screen member may be a usual woven net or a net in which the strings or the wires are arranged and connected to one another to form a grillwork.

What is claimed is:

1. A device for suppressing vibration of a structure, comprising:

a tank having an open central area, and being disposed on the structure, said tank having a circumferential and radial direction with respect to said open central area;

a liquid, contained in the tank, for suppressing vibration of the structure, the amount of the liquid being such that the natural period of the liquid is substantially equal to the natural period of the structure, said liquid being allowed to vibrate in a horizontal direction; and means, disposed within the tank, for damping the vibration of the liquid, the damping means being of a net construction and having a vertical section which includes a plurality of portions, each said portion extending in a direction intersecting said horizontal direction and at least one of said portions extending transverse to both said circumferential and radial directions.

2. A device as recited in claim 1, wherein the damping means comprises a tubular mesh screen member mounted to one of both the tank and the structure in such a manner that the axis of the screen member is disposed substantially vertically.

3. A device as recited in claim 1, wherein the damping means comprises a plurality of coaxially arranged tubular mesh screen members mounted to one of both the tank and the structure in such a manner that the axes of the tubular mesh screen members are disposed substantially vertically.

4. A device as recited in claim 3, wherein each of the tubular mesh screen members has a substantially circular cross section.

5. A device as recited in claim 3, wherein each of the screen members has a substantially polygonal cross section.

6. A device as recited in claim 5, wherein the cross section of each of the screen members is of a essentially star-like configuration.

7. A device as recited in claim 3, wherein the tank includes a bottom wall, and wherein the screen members are mounted to the bottom wall of the tank.

8. A device as recited in claim 7, wherein the bottom wall of the tank has mounting means for detachably fixing the screen members to the bottom wall, and wherein the screen members are fixed to the bottom wall through the mounting means.

9. A device for suppressing vibration of a structure, comprising:

a tank disposed on the structure, the tank having an open top and a lid member, the lid member closing the open top of the tank, the lid member having an inner face;

a liquid, contained in the tank, for suppressing vibration of the structure, the amount of the liquid being such that the natural period of the liquid is equal to that of the structure; and means, disposed within the tank, for damping the vibration of the liquid, the damping means being of a net construction, the damping means comprising a plurality of coaxial tubular mesh screen members mounted on the inner face of the lid member in such a manner that the axes of the screen members are disposed substantially vertically.

10. A device as recited in claim 3, wherein the tank has a hollow cylindrical side wall, and wherein the screen members are disposed coaxially with the side wall of the tank.

11. A device for suppressing vibration of a structure, comprising:

a tank disposed on the structure;

a liquid, contained in the tank, for suppressing vibration of the structure, the amount of the liquid being such that the natural period of the liquid is equal to that of the structure; and means, disposed within the tank, for damping the vibration of the liquid, the damping means being of a net construction, the damping means comprising a plurality of plate-like mesh screen members mounted to the tank, the screen members being substantially horizontally disposed one on top of another.

12. A device as recited in claim 11, further comprising a spacer member interposed between each of the screen members and the adjoining screen member so that the screen members are vertically spaced apart from one another.

13. A device as recited in claim 12, wherein the spacer member is of a lattice girder-like construction and extends substantially horizontally along the screen members.

14. A device as recited in claim 11, wherein each of the screen members is of a corrugated plate-like construction, and wherein the ridge lines of each of the screen members extend in a direction intersecting the ridge lines of the adjoining screen member.

15. A device for suppressing vibration of a structure, comprising:

a tank having an open central area and being disposed on the structure;

a liquid, contained in the tank, for suppressing vibration of the structure, the amount of the liquid being such that the natural period of the liquid is equal to the natural period of the structure; and damping means, disposed within the tank, for damping the vibration of the liquid, said damping means comprising at least two concentrically arranged cylindrical mesh screen members disposed within said open central area of said tank, each said cylindrical mesh screen member being of a net construction comprising a net prepared by weaving fibrous elements.

16. A device as recited in claim 15, wherein each said cylindrical mesh screen member comprises a frame of a tubular skeleton construction, and wherein the net is wound around the frame to form said cylindrical mesh screen member, each said cylindrical mesh screen being mounted to one of both the tank and the structure and in such a manner that the axis of the screen member is disposed substantially vertically.

17. A device as recited in claim 16, wherein the tank includes a bottom wall, and said bottom wall has mounting means for detachably fixing said cylindrical mesh screen member to the bottom wall, and wherein said cylindrical mesh screen member is fixed to the bottom wall through the mounting means.

* * * * *